US006302047B1

(12) United States Patent
Cannon

(10) Patent No.: US 6,302,047 B1
(45) Date of Patent: Oct. 16, 2001

(54) RETRACTABLE RUDDER ASSEMBLY FOR PERSONAL WATERCRAFT

(76) Inventor: Todd Randall Cannon, 9380 Raldon Rd, Gainesville, GA (US) 30506

( * ) Notice: Subject to any disclaimer, the term of this patent is extended or adjusted under 35 U.S.C. 154(b) by 0 days.

(21) Appl. No.: 09/661,777

(22) Filed: Sep. 14, 2000

(51) Int. Cl.[7] ..... B63H 25/06
(52) U.S. Cl. ..... 114/164; 440/43
(58) Field of Search ..... 14/164; 440/38, 440/40–43

(56) References Cited

U.S. PATENT DOCUMENTS

| | | | |
|---|---|---|---|
| 3,347,045 | 10/1967 | Warren | 60/222 |
| 3,611,980 | 10/1971 | Van Veldhuizen | 115/12 |
| 3,943,876 | 3/1976 | Kiekaefer | 115/12 R |
| 3,961,591 | 6/1976 | Fuller | 114/166 |
| 3,976,026 | 8/1976 | Eastling | 115/12 R |
| 3,982,494 | 9/1976 | Posti | 115/12 R |
| 4,050,631 | 9/1977 | Syltebo | 239/265.25 |
| 4,176,616 | 12/1979 | Robins | 115/14 |
| 4,421,489 | 12/1983 | Van Veldhuizen | 440/37 |
| 5,839,927 | 11/1998 | Thomas et al. | 440/43 |
| 6,086,437 * | 7/2000 | Murray | 440/43 |

FOREIGN PATENT DOCUMENTS 0283593 11/1990 (JP) .

* cited by examiner

*Primary Examiner*—Ed Swinehart
(74) *Attorney, Agent, or Firm*—Needle & Rosenberg, P.C.

(57) ABSTRACT

A retractable rudder assembly for use in steering a personal watercraft is disclosed. The rudder assembly includes at least one planar rudder operably coupled to an elongate shaft rotatably mounted on a water jet drive nozzle. The rudder is biased into a normally extended position in which the rudder extends away from the water jet drive nozzle for use in steering the watercraft at a throttle-off position. A paddle is affixed to the shaft and is positioned within a water jet flow path defined within the water jet nozzle so that the force of a water jet passed therethrough and striking the paddle at a throttle-on position urges the rudder into a retracted position with respect to the water jet drive nozzle. When the water jet drive is moved into the throttle-off position, the rudder is biased into its extended position for use in steering the watercraft.

20 Claims, 6 Drawing Sheets

RETRACTABLE RUDDER ASSEMBLY FOR PERSONAL WATERCRAFT

FIELD OF THE INVENTION

The invention relates in general to personal watercraft, such as jet skis and the like. More particularly, the invention relates to a retractable rudder assembly for use with personal watercraft for steering the watercraft in a throttle-off position.

BACKGROUND OF THE INVENTION

The use of personal watercraft has grown widely, and particularly the use of water jet powered watercraft, such that on any given weekend a great number of personal watercraft, to include jet skis, jet-boats and runabouts can be found in use. Each of these watercraft features a hull with a water jet drive assembly housed therein. In known fashion, the water jet drive assembly is powered by an engine operably connected to a twist grip or trigger-type throttle similar in function and appearance to that used in a motorcycle or an ATV, for example. The throttle is grasped by the hand of the watercraft operator and twisted or squeezed into a "throttle-on" position in which the engine is powered to the desired level or speed. The engine is operably coupled to a pump or an impeller for creating a pressurized water jet in the throttle-on position, the water jet being directed outwardly and away from the hull by a water jet nozzle pivotally supported on the hull of the watercraft. The water jet thus propels the watercraft in the throttle-on position. In the "throttle-off" position the engine is reduced to idle speed and the watercraft is not otherwise propelled by the water jet drive.

The water jet nozzle has two functions, the first of which, as described above, is to focus or direct the water jet in the throttle-on position in a direction away from the watercraft for propelling the watercraft. The second function of the nozzle is to steer the watercraft in the throttle-on position. If the operator falls off the watercraft during use, the throttle will automatically return to the throttle-off position and will reduce the engine speed to idle or turn the engine off. As personal watercraft are steered by the water jet as it passed through the water jet nozzle, however, if the water jet drive is throttled off it can become difficult to steer the watercraft in that these types of watercraft are not typically provided with separate rudders attached to any kind of steering device. When this occurs, therefore, it becomes difficult to efficiently, and at times safely, steer the watercraft, if at all, in the throttle-off position.

A common scenario in which this problem occurs is when a person riding a jet ski, for example, suddenly throttles-off in order to avoid colliding with another watercraft, a dock, the shore line, and/or a swimmer. The natural tendency when such an event occurs is to reduce the speed of the watercraft by throttling-off and attempting to steer the watercraft around the obstacle. If, however, the throttle of a typical personal watercraft is reduced to the throttle-off position, the operator of the watercraft suddenly loses the ability to efficiently steer the watercraft due to the loss of the dual purpose propulsion and steering water jet, and a collision may thus become inevitable as the watercraft, which is still moving at speed due to its momentum, cannot be safely steered without the water jet being passed through the nozzle of the drive assembly.

An auxiliary rudder for a jet propulsion unit is disclosed in U.S. Pat. No. 3,982,494 to Posti, which discloses a rudder moved by a hydraulic cylinder powered by a hydraulic pump and moved into a retracted position when the watercraft is operated, i.e., when it moves or is propelled at speed. The rudder assembly is constructed such that when the watercraft is moving at a sufficiently high speed a sufficient amount of water pressure is generated to supply the pump used to power the hydraulic cylinder. At speed, therefore, the pump and cylinder move the rudder into an inoperative position. If, however, the throttle is suddenly moved into a throttle-off position, for example when trying to avoid an obstacle, the watercraft will continue at speed in that it will not immediately stop. Accordingly, as sufficient water pressure still exists to keep the cylinder pumped up, the rudder will not drop down until the speed of the watercraft diminishes to the point that the water pressure is insufficient to pump the hydraulic cylinder at a force sufficient to keep the rudder in its inoperative position. Thus the rudder will only be allowed to fall into its operative position at slow speeds. By the time the rudder may be lowered, however, it may too late in that the operator of the watercraft may have already struck or passed over the obstacle prior to losing enough speed to avoid the collision.

Another rudder assembly is disclosed in the abstract of Japanese Patent Application No. 64-103253 of Kobayashi, which illustrates a rudder that is displaced upwardly when the boat strikes or runs over a shoal. The rudder is also moved upwardly into a retracted or inoperative position by the water pressure of the boat moving at a high speed, whether or not the boat is actually being propelled at that time. Again, therefore, in a throttle-off position in which there is a time lag between the throttling-off of the water jet drive and the time the watercraft loses enough speed (water pressure) to allow the rudder to extend into an operative position, the possibility exists that the obstruction which the operator of the watercraft is seeking to avoid may be struck.

What is needed, therefore, but seemingly unavailable in the art, is a retractable rudder assembly for use with a personal watercraft that will not interfere with the operation of the watercraft at a throttle-on position when the watercraft is moving at speed, but which will reliably and quickly extend downwardly into an operative position when the throttle of the drive assembly is moved into the throttle-off position, regardless of the boat speed, so that the operator of the personal watercraft retains the ability to steer the watercraft when the water jet drive is not otherwise propelling the watercraft.

SUMMARY OF THE INVENTION

The present invention provides a unique retractable rudder assembly for use with a personal watercraft which overcomes some of the design deficiencies of the known art. The retractable rudder assembly of this invention provides a simple and efficient device which allows the operator of a personal watercraft to steer the watercraft at the throttle-off position of the water jet drive assembly. The rudder assembly of this invention, when contrasted with the known rudder assemblies, seeks to provide a greater degree of reliability, durability, safety, and ease of use in addressing the problems of efficiently and safely steering a water jet powered personal watercraft in the throttle-off position.

The watercraft will have a water jet drive assembly for propelling the watercraft that includes a throttle with progressive throttle-on and throttle-off positions, and a steerable water jet nozzle through which a pressurized water jet is passed by the water jet drive at the throttle-on position(s). The rudder assembly includes a planar rudder affixed to an elongate shaft. The shaft may be either tubular or solid, as preferred. The shaft is rotatably mounted on the water jet nozzle. The rudder is biased into a normally extended position in which the rudder extends in a downward direction away from the water jet drive nozzle for use in steering the watercraft at the throttle-off position. The rudder also has a retracted position in which it is moved toward the water jet drive nozzle when the water jet drive is propelling the watercraft for minimizing the possibility of damaging the rudder at speed, striking an object therewith, and/or injuring a person with the rudder should the watercraft pass close by.

The rudder assembly also includes a paddle affixed to the above-described shaft, the paddle being positioned within a water jet flow path defined within the nozzle so that the force of the water jet at the throttle-on position striking the paddle urges the rudder into its retracted position. A spring is affixed to the shaft rotatably mounted on water jet nozzle, the rudder being biased into its extended position by the spring. The force of the water jet, at the throttle-on position of the water jet drive, striking the paddle within the water jet flow path rotates the shaft against the bias of the spring, to move the rudder into its retracted position.

The shaft may be formed to have an airfoil-shaped cross section formed transversely with respect to the length of the shaft. The rudder assembly may include a single rudder affixed to the shaft, a pair of spaced and parallel rudders affixed to the shaft, or a rudder or rudders affixed directly to the actuating paddle positioned within the water jet flow path.

A novel method of steering a water jet powered watercraft results from this invention, the method including the steps of rotatably positioning a planar paddle within a water jet flow path so that the paddle is struck and at least partially rotated by the water jet when the water jet drive is in a throttle-on position, urging a rudder mounted on the water jet nozzle and operably coupled to the paddle into a retracted position with respect to the water jet nozzle at the throttle-on position, biasing the rudder into a normally extended position with respect to the water jet nozzle at a throttle-off position of the water jet drive, and steering the watercraft at the throttle-off position with the rudder in its extended position.

It is to these objects, as well as the other objects, features, and advantages of the present invention to which the invention is directed.

DETAILED DESCRIPTION

Figure 1:
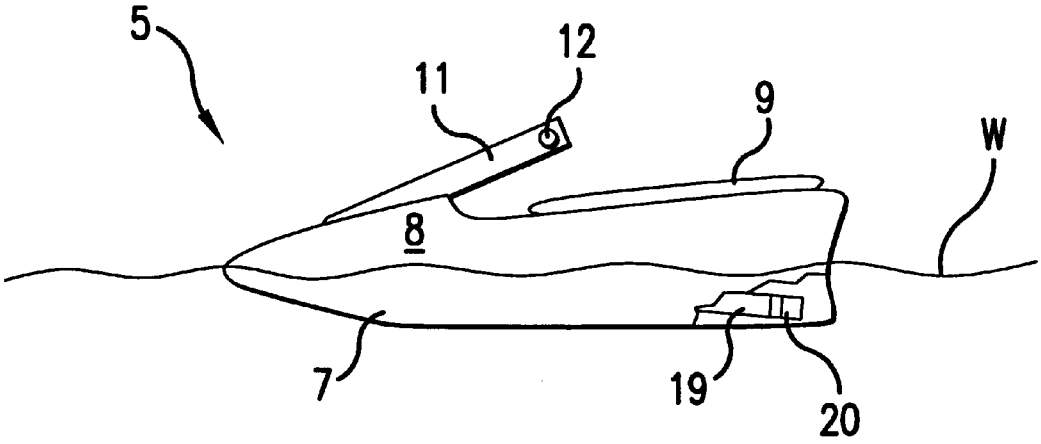
FIG. 1 is a side elevational view in partial cross-section of a waterjet powered personal watercraft.

Referring now in detail to the drawings, in which like reference characters indicate like parts throughout the several views, a water jet powered personal watercraft 5 is illustrated in FIG. 1. The watercraft includes a hull 7 with an upper portion 8, with a seating surface 9 provided as a part of the upper portion of the watercraft. The watercraft also includes a steering member 11 having a pair of hand grips, one of which also functions as a twist grip or trigger-type throttle 12.

Figure 2:
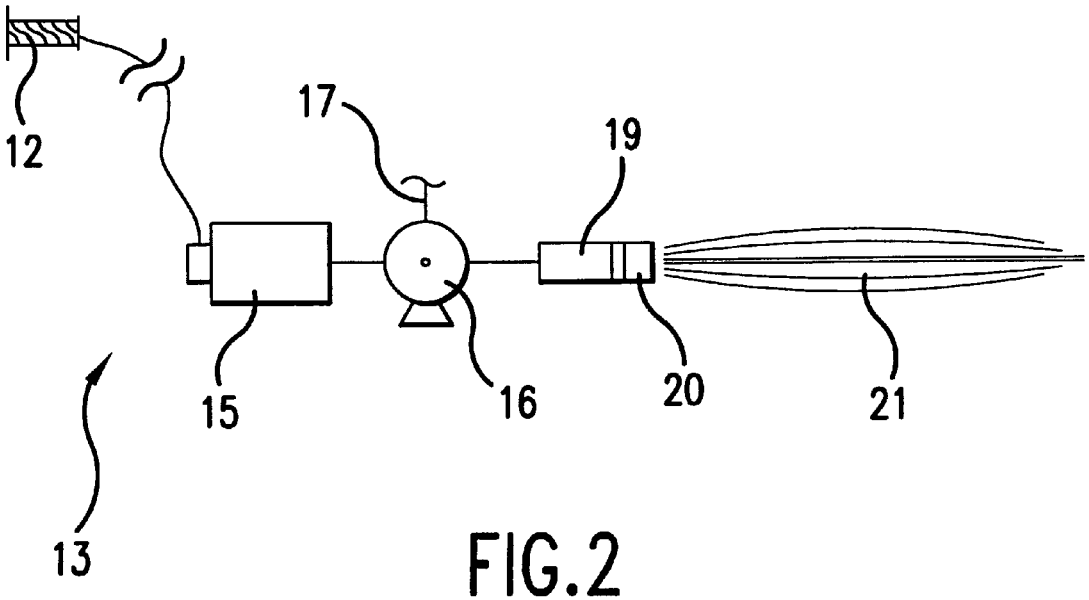
FIG. 2 is a schematic illustration of the water jet drive of the watercraft of FIG. 1

As schematically illustrated in FIG. 2, the personal watercraft is powered by a water jet drive assembly 13 having a drive engine 15 operably coupled to the throttle and to a pump or an impeller 16. The impeller is provided with water through a water inlet 17 leading into the impeller, and discharged therefrom through a discharge conduit 19. A water jet nozzle 20 is pivotally affixed to the hull of the watercraft, and is in fluid communication with the distal end of the discharge conduit. The nozzle is operably coupled to the steering member 11 of the watercraft. In operation, namely in the throttle-on position of the drive assembly, a water jet 21 is emitted through the discharge conduit and the water jet nozzle for propelling the watercraft in a direction opposite the water jet. As the water jet nozzle is pivotally affixed to the hull of the watercraft, and is operatively coupled to the steering member 11, the water jet nozzle is also used to steer the personal watercraft in the throttle-on position, as known.

Figure 3:
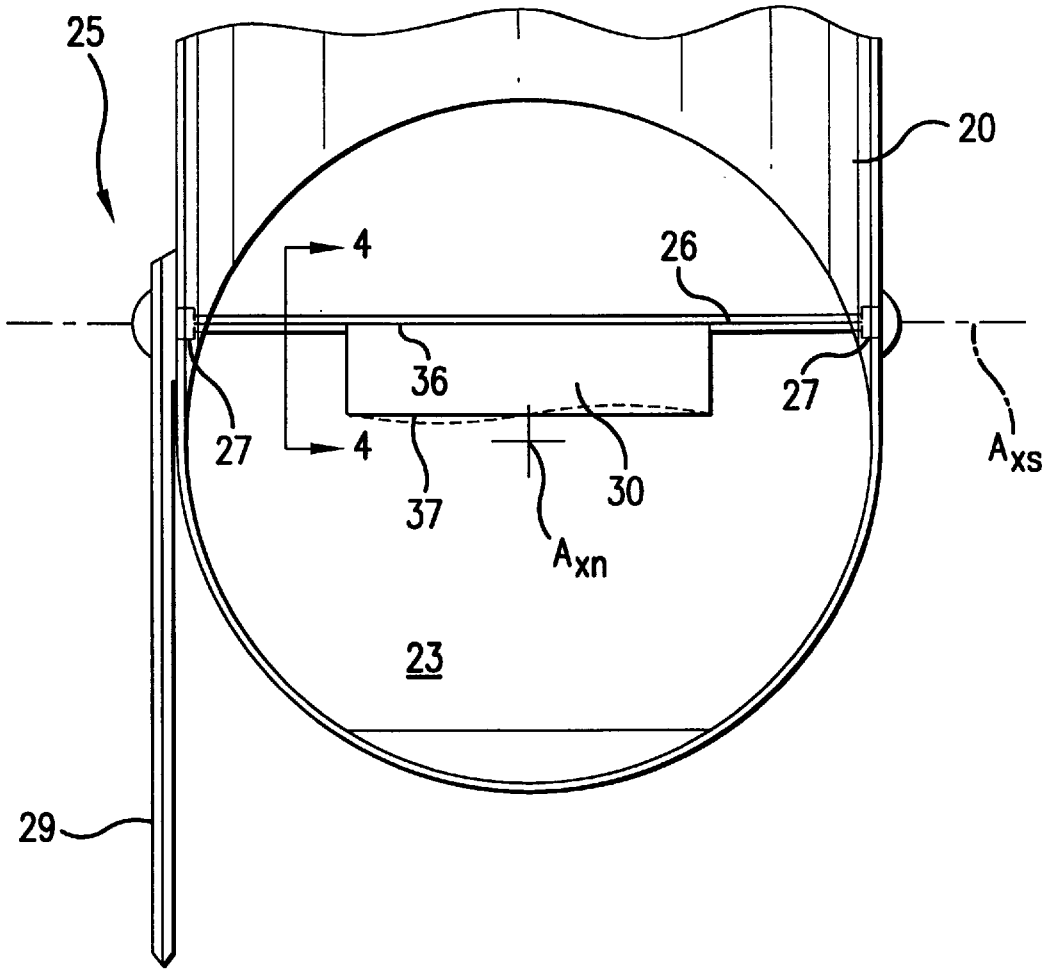
FIG. 3 is an end elevational view of a first embodiment of the retractable rudder assembly of this invention.

A first embodiment of the retractable rudder assembly 25 is illustrated in FIG. 3. The water jet nozzle 20, illustrated in FIGS. 1 and 2, defines a water jet flow path 23 therein and extending therethrough and through which the water jet 21, schematically illustrated in FIG. 2, is passed. The rudder assembly of FIG. 3 includes an elongate shaft 26 rotatably mounted on the water jet nozzle. The shaft is journaled with suitable bearings 27, which may be journal bearings, sealed roller bearings, or any type of bearing suitable for use in either salt water or fresh water environments.

A planar rudder 29 is affixed to one end of the shaft 26, and is shown extended downwardly in an extended position for use in steering the watercraft at a throttle-off position in which the water jet 21 passed along the water jet flow path and through the nozzle is in a minimal or nominal flow state. A planar paddle 30 is affixed to the shaft 26, and positioned within the water jet flow path 23.

The shaft 26 may have an airfoil-shaped cross-section 33 such that during operation of the watercraft, mainly when the water jet is passed through the water jet flow path 23 at the throttle-on position of the drive assembly 13, the shaft provides minimal interference to the flow of the water jet passed through the nozzle. A spring 34 is affixed to the shaft 26, and is constructed and arranged to bias the rudder 29, as well as rudders 47, 57, 67 and 68 of the several embodiments of this invention, into the normally extended position of the rudder(s) shown in FIGS. 3, 5, 6, 7, and 9A, respectively. The spring may be formed and shaped as desired, and may comprise a torsion spring, a leaf-type spring, a coil or wound spring, a helical spring, or any other type of spring suitable for use in either a salt water or fresh water environment, and adapted for rotating the shaft 26 to in turn rotate the respective rudders of the several embodiments of the invention described herein.

Figure 4:
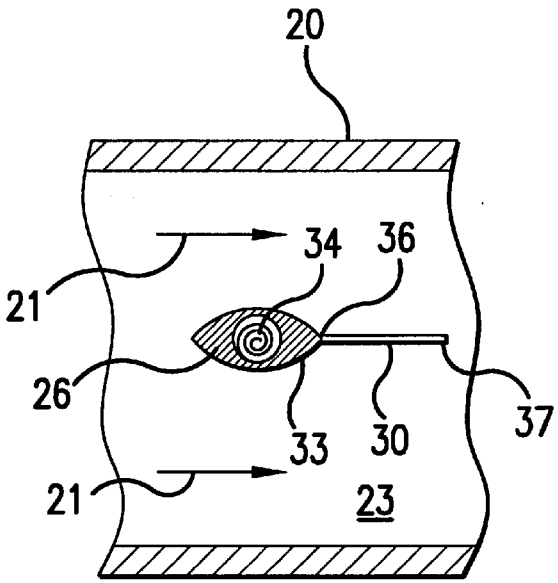
FIG. 4 is a side elevational view in cross-section along line 4—4 of FIG. 3.

As shown in FIG. 4, should the spring 34 be a torsion spring, for example, then the shaft 26 would be hollow, i.e., tubular, as would be the respective shafts 46 (FIG. 5), 56 (FIG. 6), 66 (FIG. 7), and/or 76 (FIG. 9A) for the other embodiments of the invention, with an elongate torsion rod or spring 34 affixed at one end thereof to the nozzle/nozzle housing of the watercraft, and at its other end to the shaft. The torsion spring would be mounted within the interior of the shaft, as shown in FIG. 4. When the water jet strikes the paddle, the paddle will rotate the shaft against the bias of the torsion spring, which has the effect of twisting the spring. When the water jet stops, the bias of the torsion spring will return the shaft back into its normal position, in which the attached rudder(s) 47, 57, 67, 68, or 79, respectively, extend (s) away from the nozzle for use in steering the watercraft.

Figure 8:
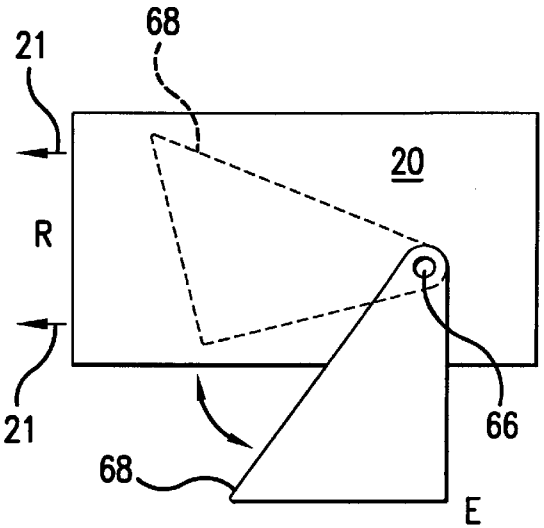
FIG. 8 is schematic illustration of the extended and retracted positions of the retractable rudder assembly of this invention.

Still referring to FIG. 4, the paddle 3 has a leading edge 36 affixed to the shaft 26, and a trailing edge 37 extending away therefrom, and as shown in FIG. 4, extending along the water jet flow path 23. The paddle 30 illustrated in FIG. 4 is shown in a rotated position with respect to the position of the paddle in FIG. 3, which paddle rotation is caused by the operation of the water jet drive assembly 13 (FIG. 2) emitting the water jet 21. As the water jet strikes the paddle, the paddle is moved or rotated into alignment with the water jet along the water jet flow path within the nozzle. As the paddle moves, the shaft 26 moves, or winds, the spring 34, and the rudder 29 is rotated from the extended position into its retracted position, schematically illustrated in FIG. 8. Referring now to FIG. 3, in this embodiment of the rudder assembly the shaft 26 extends across the water jet flow path 23 above the longitudinal axis of the water jet nozzle denoted by the reference characters $A_{xn}$.

The paddle 30 is positioned centrally along the shaft 26 within the water jet flow path 23, and may have either a "straight" trailing edge 37, as shown, or a spiraled or cambered trailing edge, as shown by the broken lines in FIG. 3. It is understood by those skilled in the art that the water jet drive 15 may form the water jet 21 into a spiral water jet as it is emitted from the distal end of the water jet nozzle 20. Thus, it is anticipated that the trailing edge 37 of the paddle 30, as well as any of the paddles used in all of the embodiments of this invention, may have a complimentary spiral or cambered shape to it such that the paddle will diminish to the greatest extent possible the spiral imparted to the water jet by the water jet drive assembly.

Figure 5:
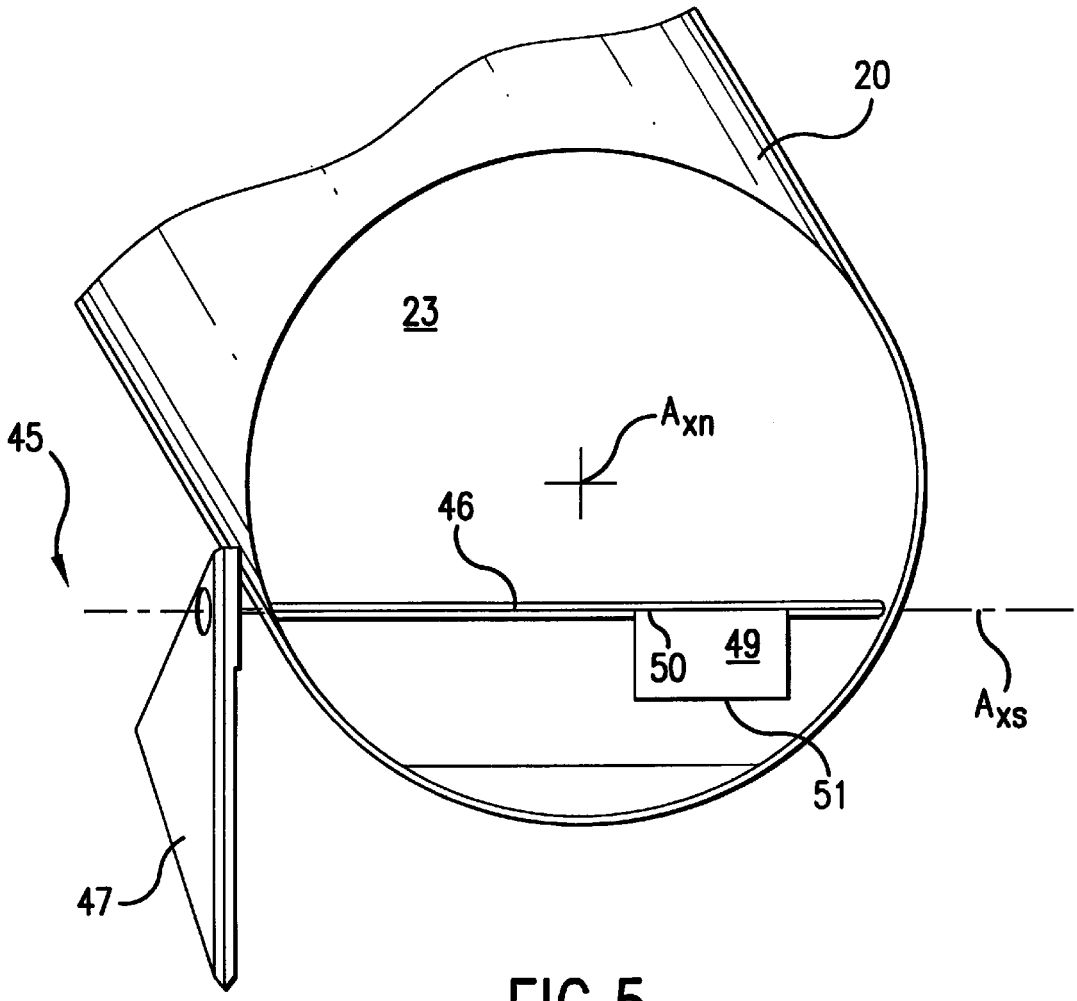
FIG. 5 is an end elevational perspective view of a second embodiment of the retractable rudder assembly of this invention.

A second embodiment of a retractable rudder assembly 45 is illustrated in FIG. 5. The rudder assembly 45 includes an elongate shaft 46 constructed in fashion similar to the shaft 26 of FIGS. 3 and 4, to which a planar rudder 47 is affixed. A paddle 49 is positioned within the water jet flow path 23, the leading edge 50 of the paddle being affixed to the shaft 46, and the trailing edge 51 extending away therefrom. As shown in FIG. 5, the longitudinal axis of the shaft 46, denoted by the reference character $A_{xs}$, is positioned below the longitudinal axis $A_{xn}$ of the water jet nozzle 20.

Figure 6:
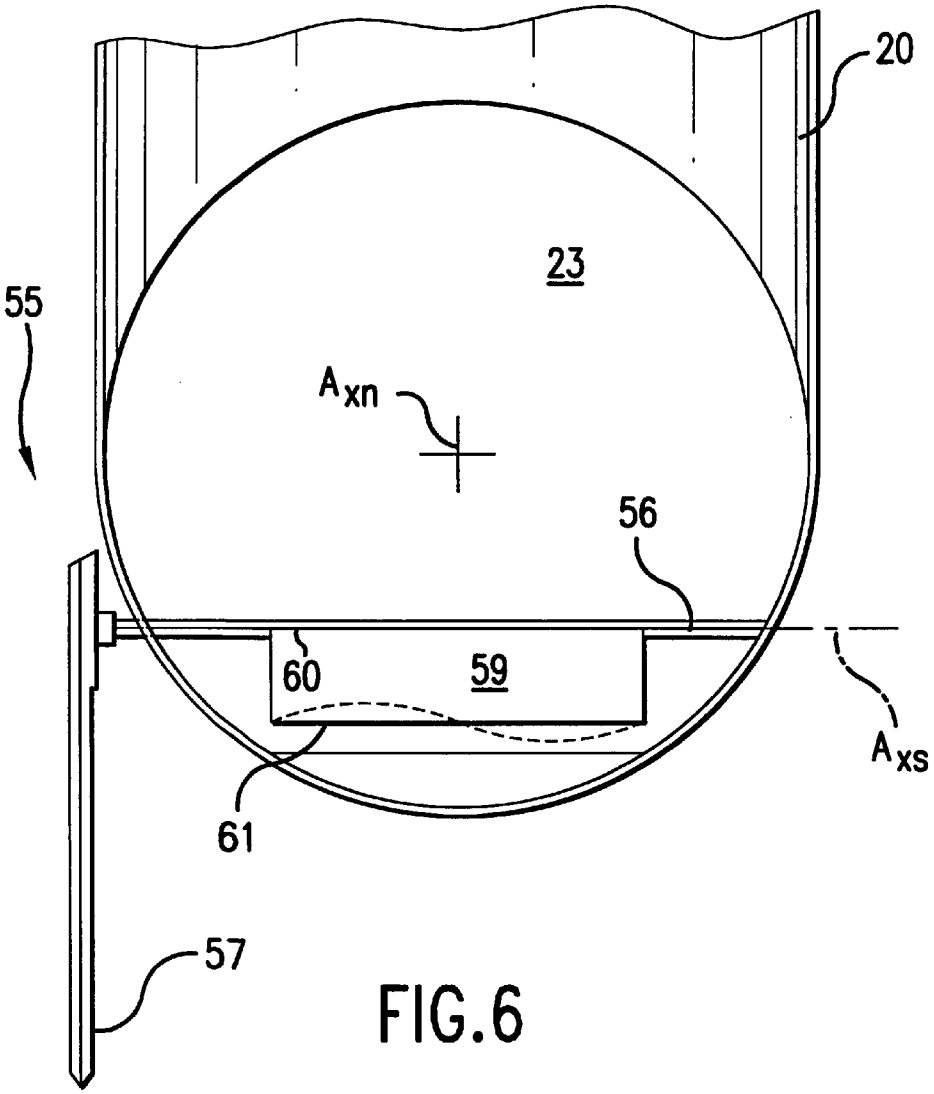
FIG. 6 is an end elevational view of a third embodiment of the retractable rudder assembly of this invention.

A third embodiment of a retractable rudder assembly 55 is illustrated in FIG. 6. Here a shaft 56 is used, which shaft is constructed in similar fashion as the shaft 26. The shaft 56 is rotatably supported on the water jet nozzle 20, and a planar rudder 57 is affixed to the shaft. A paddle 59 is also affixed to the shaft, along a leading edge 60 of the paddle, with a trailing edge 61 extending away therefrom. Here the longitudinal axis $A_{xs}$ of the shaft 56 is positioned below the longitudinal axis $A_{xn}$ of the water jet nozzle 20, however, the paddle is positioned centrally along the shaft 56, and extends for a greater distance along shaft 56 than does paddle 49 on shaft 46.

Figure 7:
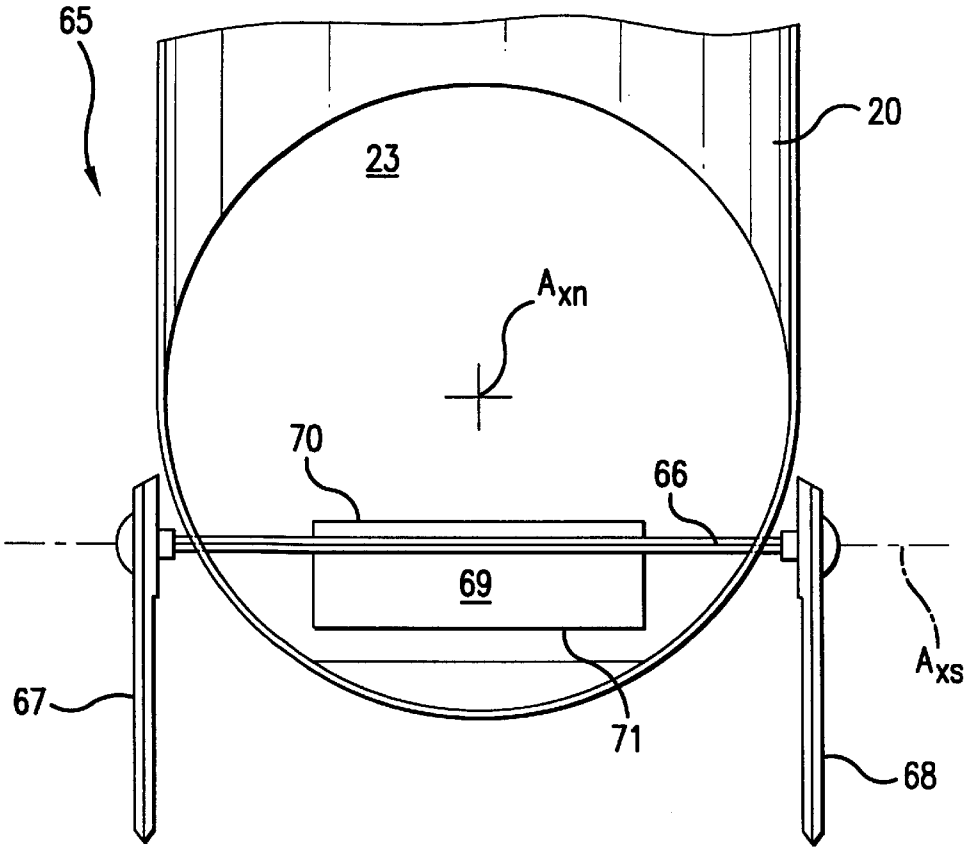
FIG. 7 is an end elevational view of a fourth embodiment of the retractable rudder assembly of this invention.

A fourth embodiment of a retractable rudder assembly 65 is illustrated in FIG. 7. Again, an elongate tubular shaft 66, constructed in fashion similar to the shaft 26, is rotatably supported on the water jet nozzle 20. However, in this embodiment of the rudder assembly a first planar rudder 67 and a second spaced parallel planar rudder 68 are affixed to opposite ends of the shaft 66. A paddle 69 is affixed to the shaft 66, the paddle being positioned within the water jet flow path 23 defined within the nozzle 20.

Figure 9B:
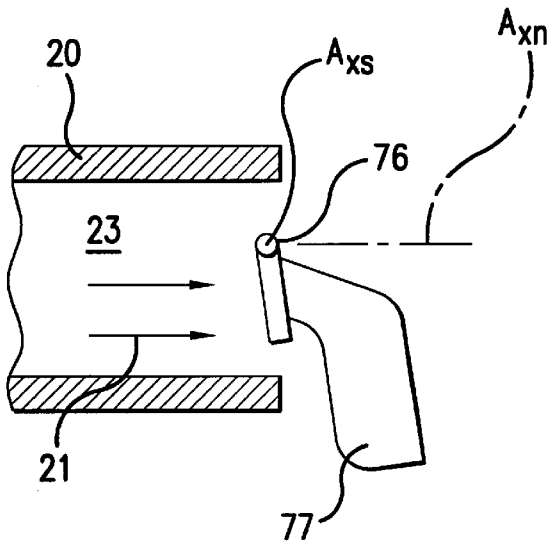
FIG. 9B is a partial side elevational view, in partial cross-section, of the rudder assembly of FIG. 9A.
Figure 9A:
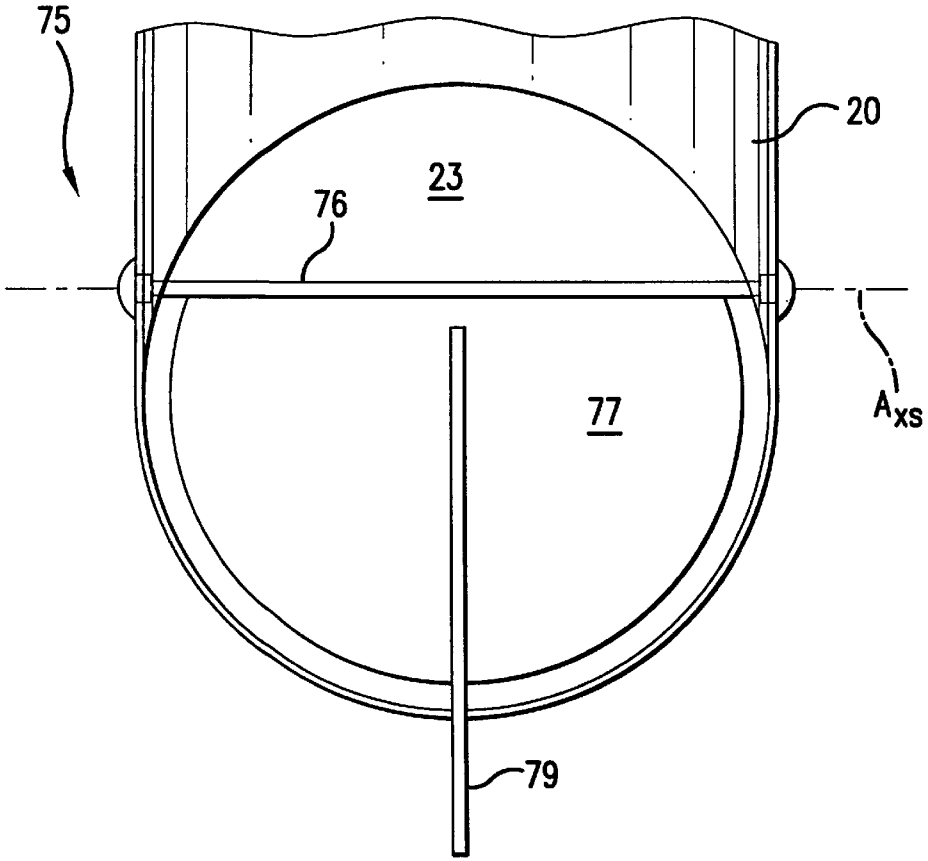
FIG. 9A is an end elevational view of a fifth embodiment of the retractable rudder assembly of this invention.

A fifth embodiment of a retractable rudder assembly 75 is illustrated in FIGS. 9A and B. An elongate shaft 76, constructed in fashion similar to the shaft 26, is provided. The shaft is once again rotatably supported on the water jet nozzle 20. A paddle 77 is affixed to the shaft 76, the leading edge of the paddle being affixed to the shaft, the trailing edge of the paddle being arcuate in a shape complimentary to the configuration of the water jet nozzle and flow path. Here a single planar rudder 79 is provided, which rudder is shown as being directly and centrally mounted to the paddle rather than on the shaft, and more particularly on an end of the shaft. The rudder may be affixed to the shaft, however, if so desired, the paddle rotating the shaft, and the shaft in turn rotating the rudder. By placing the rudder centrally with respect to the longitudinal axis of the water jet flow, a more direct steering response of the watercraft may be possible regardless of the direction in which the watercraft is being steered. The longitudinal axis $A_{xs}$ of the shaft 76 may be positioned above, even with, or below the longitudinal axis $A_{xn}$ of the water jet nozzle, as desired.

The manner in which the paddle is mounted to the respective shafts of the several embodiments of the invention may vary as desired, and as necessary based on the specific operating characteristics of the water jet drive with which the retractable water assembly is being used. This may include the force of the water jet emitted by the drive, how tightly the water jet is spiraled, how fast it is anticipated that the watercraft will move, and how large the respective rudders of the several embodiments of the invention are, such that a sufficient force is generated by the water jet striking the respective paddles to rotate the rudders into their respective retracted position, shown by the broken lines of the rudder 67 in FIG. 8, when the water jet drive is in the throttle-on position. In addition, the several embodiments of the rudders 29, 47, 57, 67, 68, and 79, respectively, may be designed as desired, based on what will be the operational parameters of the watercraft, namely its size, weight, speed, and the construction of the watercraft itself to ensure that a sufficient amount of rudder surface is provided for efficiently and safely steering the watercraft in a throttle-off position.

As disclosed hereinabove, and as illustrated in FIGS. 1–9B, the construction of the retractable rudder assembly ensures that the rudder, or rudders, of the several embodiments of the invention is/are biased into a normally extended position in which the rudder extends away from, and/or below the water jet nozzle 20 for use in steering the watercraft at the throttle-off position. In each of the several embodiments of the retractable rudder assembly of the invention, when the water jet drive emits the water jet 21 that powers the watercraft, the water jet will strike or impinge the paddle, and will rotate the paddle in the direction of the water jet along the water jet flow path while simultaneously rotating the shaft about its longitudinal axis $A_{xs}$ and in turn moving the rudder, in its several respective embodiments, from the extended position shown in FIGS. 3, 5, 6, 7, and 9A & B, respectively, into the retracted position shown in FIG. 8. When the water jet 21 is no longer passed from the nozzle, which occurs when the throttle 12 is moved into the throttle-off position, the force of the spring, or springs, used with the rotatable shaft of this invention will urge the rudder or rudders into its or their extended position(s) so that the watercraft can be efficiently steered.

The components of the respective rudder assemblies 25, 45, 55, 65, and 75 as illustrated herein, may be fashioned of conventional materials, so long as these materials are suitable for use in either a salt water or fresh water marine environment. Additionally, the materials used to construct the rudder assembly will be rugged and durable such that, for example, if the operator of the watercraft slides the watercraft onto shore, the rudder assembly will not be damaged.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed herein, and that many modifications and other embodiments of the invention are intended to be included in the scope of the appended claims. Moreover, although specific terms are employed herein, as well as in the claims, they are used in the generic and descriptive sense only and not for the purposes of limited the described invention, nor the claims which follow.

I claim:

1. A retractable rudder assembly for use in steering a personal watercraft at a throttle-off position, the watercraft having a water jet drive including a throttle and a steerable water jet nozzle through which a pressurized water jet is passed by the jet drive at a throttle-on position for propelling and steering the watercraft, the nozzle having a water jet flow path defined therein, said rudder assembly comprising:

a planar rudder affixed to an elongate shaft adapted to be rotatably mounted on the water jet nozzle;

said rudder being biased into a normally extended position in which the rudder is adapted to extend away from the water jet drive nozzle for use in steering the watercraft at the throttle-off position; and a paddle affixed to said shaft and adapted to be positioned within the water jet flow path so that the force of the water jet at the throttle-on position striking the paddle—urges the rudder into a retracted position in which the rudder is adapted to be moved toward the water jet drive nozzle as the watercraft is propelled at the throttle-on position.

2. The rudder assembly of claim 1, further comprising a spring operably coupled to said shaft, said rudder being biased into its extended position by said spring.

3. The rudder assembly of claim 2, wherein the force of the water jet at the throttle-on position striking the paddle rotates the shaft against the bias of said spring to rotate the shaft and the rudder carried thereon into said retracted position.

4. The rudder assembly of claim 1, wherein the paddle is adapted to rotate said shaft and the rudder carried thereon into said retracted position as the force of the water jet at the throttle-on position strikes the paddle.

5. The rudder assembly of claim 1, said paddle being adapted to extend in a lengthwise direction along said shaft within the water jet flow path of the water jet nozzle.

6. A retractable rudder assembly for use in steering a personal watercraft at a throttle-off position, the watercraft having a water jet drive including a throttle and a steerable water jet nozzle through which a pressurized water jet is passed by the drive assembly at a throttle-on position for propelling and steering the watercraft, the nozzle having a water jet flow path defined therein, said rudder assembly comprising:

an elongate shaft adapted to be rotatably mounted on the water jet nozzle and extended through the water jet flow path;

a planar rudder operably coupled to said shaft, said rudder being biased into a normally extended position in which the rudder is adapted to extend away from the water jet drive nozzle for use in steering the watercraft at the throttle-off position; and a planar paddle affixed to that portion of said shaft extended through the water jet flow path so that the paddle is adapted to be positioned within the water jet flow path;

wherein the paddle is adapted to rotate said shaft and to urge the rudder carried thereon into a retracted position as the force of the water jet at the throttle-on position strikes the paddle, the rudder in said retracted position being adapted to be moved toward the water jet drive nozzle as the watercraft is propelled at the throttle-on position.

7. The rudder assembly of claim 6, further comprising a spring operably coupled to said shaft, said rudder being biased into its extended position by said spring.

8. The rudder assembly of claim 6, said shaft having an airfoil-shaped cross section formed transversely with respect to length of the shaft.

9. The rudder assembly of claim 6, said paddle having a leading edge and a spaced trailing edge.

10. The rudder assembly of claim 9, said paddle being affixed to said shaft along the leading edge of the rudder.

11. The rudder assembly of claim 9, said paddle being affixed to said shaft intermediate the respective leading and trailing edges of the paddle.

12. The rudder assembly of claim 6, said rudder comprising a first planar rudder affixed to a first end of said shaft and a spaced second planar rudder affixed to a second end of said shaft, each of said first and said second rudders, respectively, being biased into said extended position, and said retracted position.

13. The rudder assembly of claim 6, wherein said rudder is adapted to extend below the water jet nozzle at the throttle-off position of the water jet drive.

14. The rudder assembly of claim 6, wherein said rudder lies in a lengthwise direction adapted to extend along the length of the water jet nozzle at the throttle-on position of the water jet drive.

15. The rudder assembly of claim 6, further comprising an actuator operably coupled to said rudder and being constructed and arranged to move the rudder from its retracted position into its extended position, and back.

16. The rudder assembly of claim 6, said rudder being affixed to said paddle and moved from said extended position into said retracted position by said paddle rotating said shaft.

17. The rudder assembly of claim 6, said rudder being affixed to an end of said shaft.

18. A retractable rudder assembly for use in steering a personal watercraft at a throttle-off position, the watercraft having a water jet drive including a throttle and a steerable water jet nozzle through which a pressurized water jet is passed by the drive assembly at a throttle-on position for propelling the watercraft and for steering the watercraft, the nozzle having a water jet flow path defined therein, said rudder assembly comprising:

an elongate shaft adapted to be rotatably mounted on the water jet nozzle;

at least one planar rudder operably coupled to said shaft, said at least one rudder being biased into a normally extended position in which the at least one rudder is adapted to extend away from the water jet drive nozzle for use in steering the watercraft at the throttle-off position; and a planar paddle affixed to said shaft, the paddle being adapted to be positioned within the water jet flow path;

wherein the at least one rudder is adapted to be urged into a retracted position with respect to the water jet nozzle by the paddle when the force of the water jet at the throttle-on position impinges the paddle.

19. The rudder assembly of claim 18, further comprising a spring operably coupled to said shaft, said rudder being biased into its extended position by said spring.

20. A method of steering a personal watercraft at a throttle-off position, the watercraft having a water jet drive including a throttle and a steerable water jet nozzle through which a pressurized water jet is passed by the jet drive at a throttle-on position for propelling and steering the watercraft, the nozzle having a water jet flow path defined therein, the method comprising the steps of:

rotatably positioning a planar paddle within the water jet flow path so that the paddle is struck and at least partially rotated by the water jet when the water jet drive is in the throttle-on position;

urging a rudder mounted on the water jet nozzle and operably coupled to the paddle into a retracted position with respect to the water jet nozzle at the throttle-on position of the water jet drive;

biasing the rudder into a normally extended position with respect to the water jet nozzle at the throttle-off position of the water jet drive; and steering the watercraft at the throttle-off position with the rudder in its extended position.

* * * * *